US007982124B1

(12) United States Patent
Landis et al.

(10) Patent No.: US 7,982,124 B1
(45) Date of Patent: Jul. 19, 2011

(54) WIRELESS GUITAR SYNTHESIZER

(76) Inventors: John A. Landis, Taylor, TX (US); Thomas Prevost, La Mirada, CA (US)

( * ) Notice: Subject to any disclaimer, the term of this patent is extended or adjusted under 35 U.S.C. 154(b) by 0 days.

(21) Appl. No.: 12/698,549

(22) Filed: Feb. 2, 2010

Related U.S. Application Data

(60) Provisional application No. 61/149,574, filed on Feb. 3, 2009.

(51) Int. Cl.
*G10H 3/14* (2006.01)
*G10H 1/02* (2006.01)

(52) U.S. Cl. ..... 84/727; 84/737

(58) Field of Classification Search ..... 84/727, 84/737, 322

See application file for complete search history.

(56) References Cited

U.S. PATENT DOCUMENTS

| | | | | | |
|---|---|---|---|---|---|
| 5,105,711 | A * | 4/1992 | Barnard | 84/744 |
| 5,245,128 | A * | 9/1993 | Araiza | 84/626 |
| 5,315,060 | A * | 5/1994 | Paroutaud | 84/726 |
| 5,449,858 | A * | 9/1995 | Menning et al. | 84/727 |
| 5,633,474 | A * | 5/1997 | Cardey, III | 84/663 |
| 5,693,904 | A * | 12/1997 | Kihneman et al. | 84/725 |
| 5,698,808 | A * | 12/1997 | Hamlin | 84/722 |
| 5,864,083 | A * | 1/1999 | Caren | 84/737 |
| 6,946,592 | B1 * | 9/2005 | Chick | 84/322 |
| 7,339,107 | B2 * | 3/2008 | Remignanti | 84/737 |
| 7,501,571 | B2 * | 3/2009 | Forsman et al. | 84/737 |
| 2007/0000375 | A1 * | 1/2007 | Harrison | 84/737 |
| 2007/0175322 | A1 * | 8/2007 | Baum et al. | 84/737 |
| 2008/0004861 | A1 * | 1/2008 | Holzrichter et al. | 704/2 |

* cited by examiner

*Primary Examiner* — Jeffrey Donels
(74) *Attorney, Agent, or Firm* — Neustel Law Offices

(57) ABSTRACT

A wireless guitar synthesizer for creating theremin like sounds on an unmodified electric guitar. The wireless synthesizer generally includes a portable housing adapted to be moved independent of an electric guitar to influence a sound outputted by an audio means connected to the guitar and a circuit supported by the housing for generating an electromagnetic field to be received by the coil pickup of the guitar to influence the outputted sound. The circuit generally includes a signal generator for producing an output signal, at least one user-adjustable modulator electrically coupled to the signal generator for varying the output signal, and an LED antenna array electrically coupled to the signal generator to receive the modulated output signal and output the electromagnetic field. The user-adjustable modulators may include a joystick movable along an X-Y axis, as well as a plurality of switches, each of which independently alter the output signal.

19 Claims, 10 Drawing Sheets

WIRELESS GUITAR SYNTHESIZER

CROSS REFERENCE TO RELATED APPLICATIONS

I hereby claim benefit under Title 35, United States Code, Section 119(e) of U.S. provisional patent application Ser. No. 61/149,574 filed Feb. 3, 2009. The 61/149,574 application is currently pending. The 61/149,574 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to guitar synthesizers and theremins and more specifically it relates to a wireless guitar synthesizer for efficiently creating theremin like sounds on an unmodified electric guitar for use in musical performances.

2. Description of the Related Art

Any discussion of the related art throughout the specification should in no way be considered as an admission that such related art is widely known or forms part of common general knowledge in the field.

It can be appreciated that musical effect devices have been in use for years and may comprise various devices, such as but not limited to synthesizers and theremins. Synthesizers are common on most electric guitars and are used to generate musical effects through the guitar. However, prior guitar synthesizers do not generally produce a true or eerie sound which can be desired during various musical performances. Such true or eerie sounds are typical of theremins.

The main problem with conventional theremins are that they are very difficult to use and learn to play, wherein a conventional theremin generally solely relies on the user's ability to proximate their hands or fingers relative to the antennae or control element. Another problem with conventional theremins is that they are expensive and complicated to make and repair, thus proving to be unaffordable for many musicians. A further problem with conventional theremins is that they often require extensive modification which may also be expensive and time consuming. Because of the inherent problems with the related art, there is a need for a new and improved wireless guitar synthesizer for efficiently creating theremin like sounds on an unmodified electric guitar for use in musical performances.

BRIEF SUMMARY OF THE INVENTION

A system for efficiently creating theremin like sounds on an unmodified electric guitar for use in musical performances. The invention generally relates to guitar synthesizers and theremins which includes a portable housing adapted to be moved independent of an electric guitar to influence a sound outputted by an audio means connected to the guitar and a circuit supported by the housing for generating an electromagnetic field to be received by the coil pickup of the guitar to influence the outputted sound. The circuit generally includes a signal generator for producing an output signal, at least one user-adjustable modulator electrically coupled to the signal generator for varying the output signal, and an LED antenna array electrically coupled to the signal generator to receive the modulated output signal and output the electromagnetic field. The user-adjustable modulators may include a joystick movable along an X-Y axis, as well as a plurality of switches, each of which independently alter the output signal.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
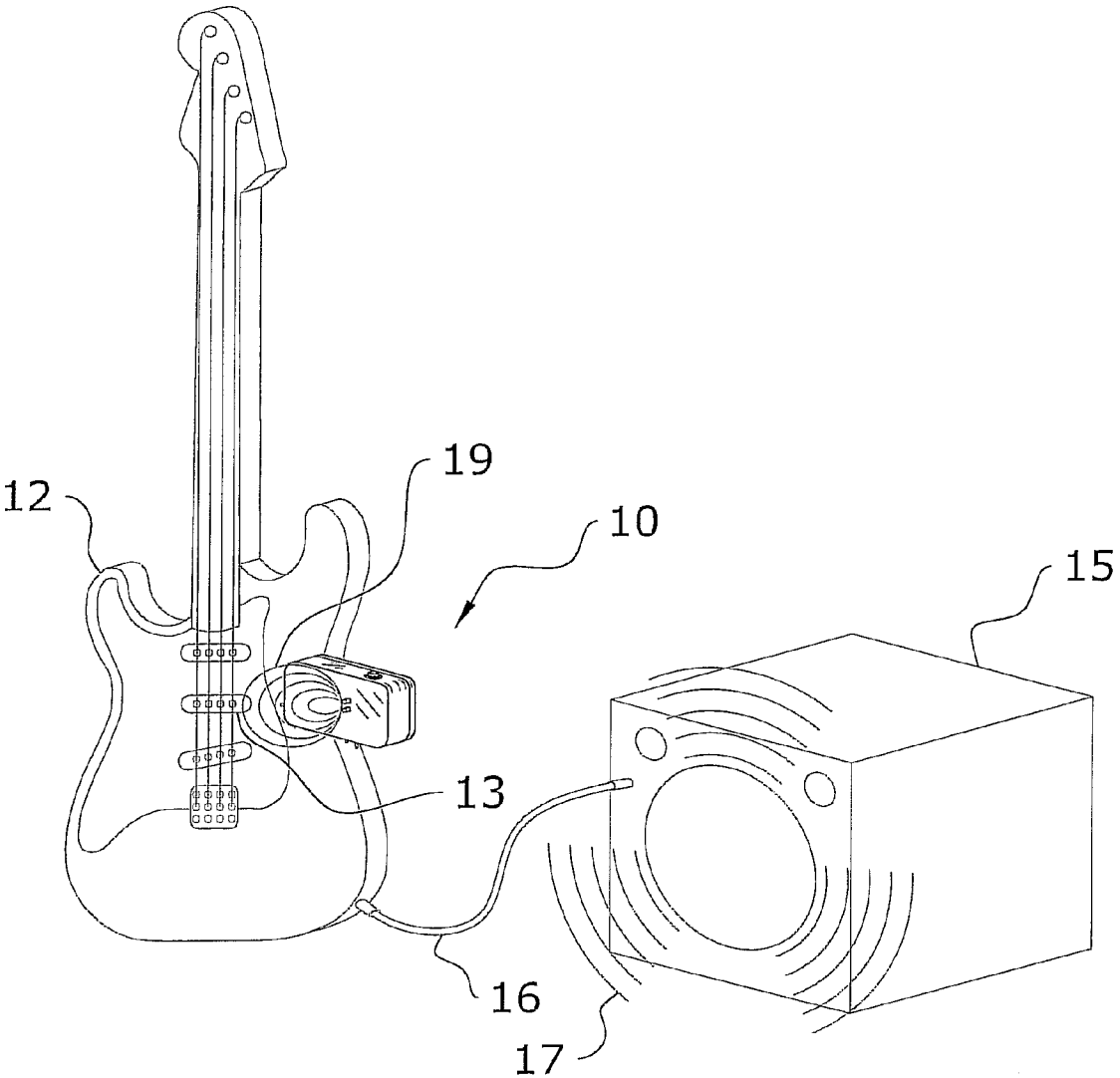
FIG. 1 is an upper perspective view of the present invention in use.
Figure 2:
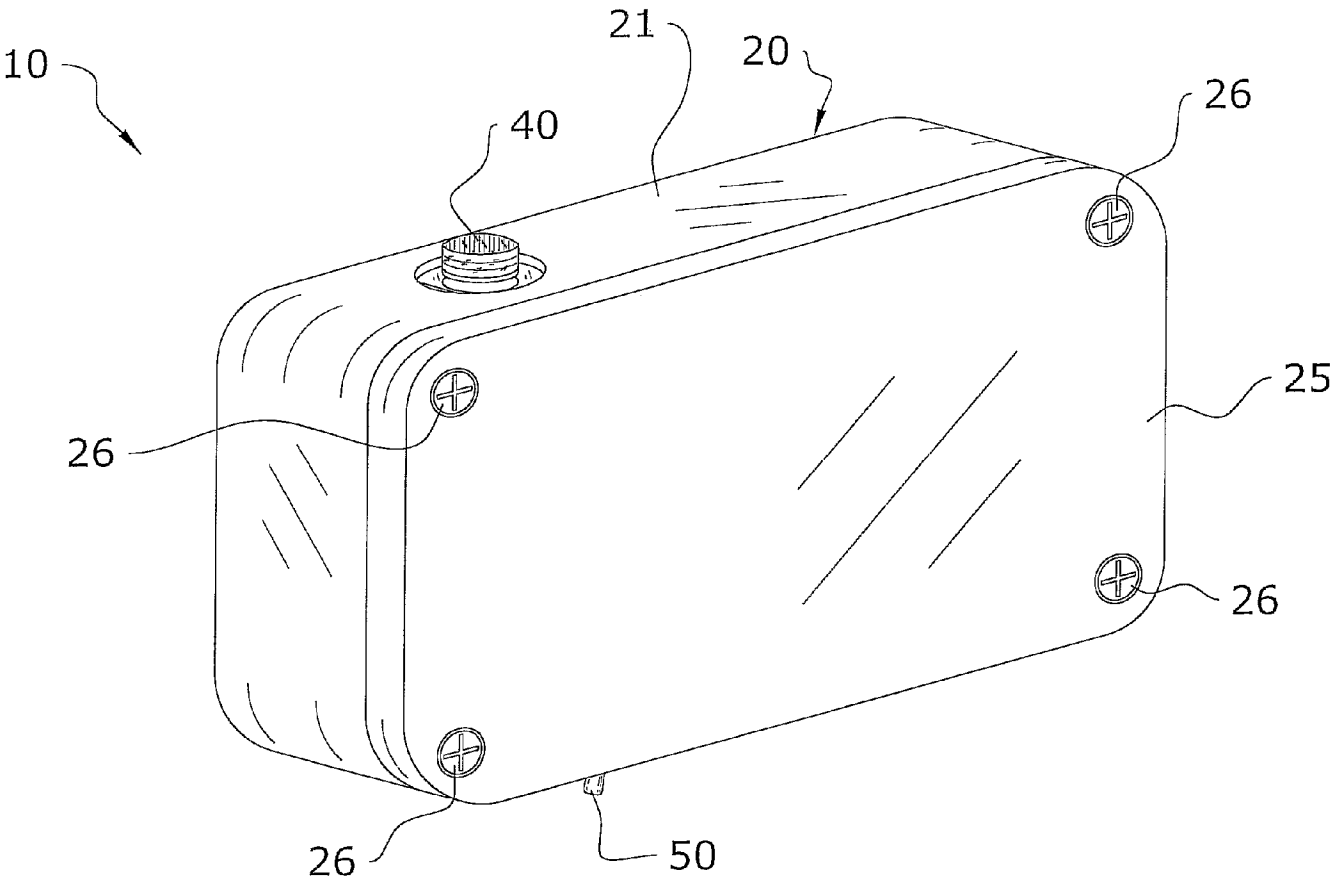
FIG. 2 is an upper front perspective view of the present invention.
Figure 3:
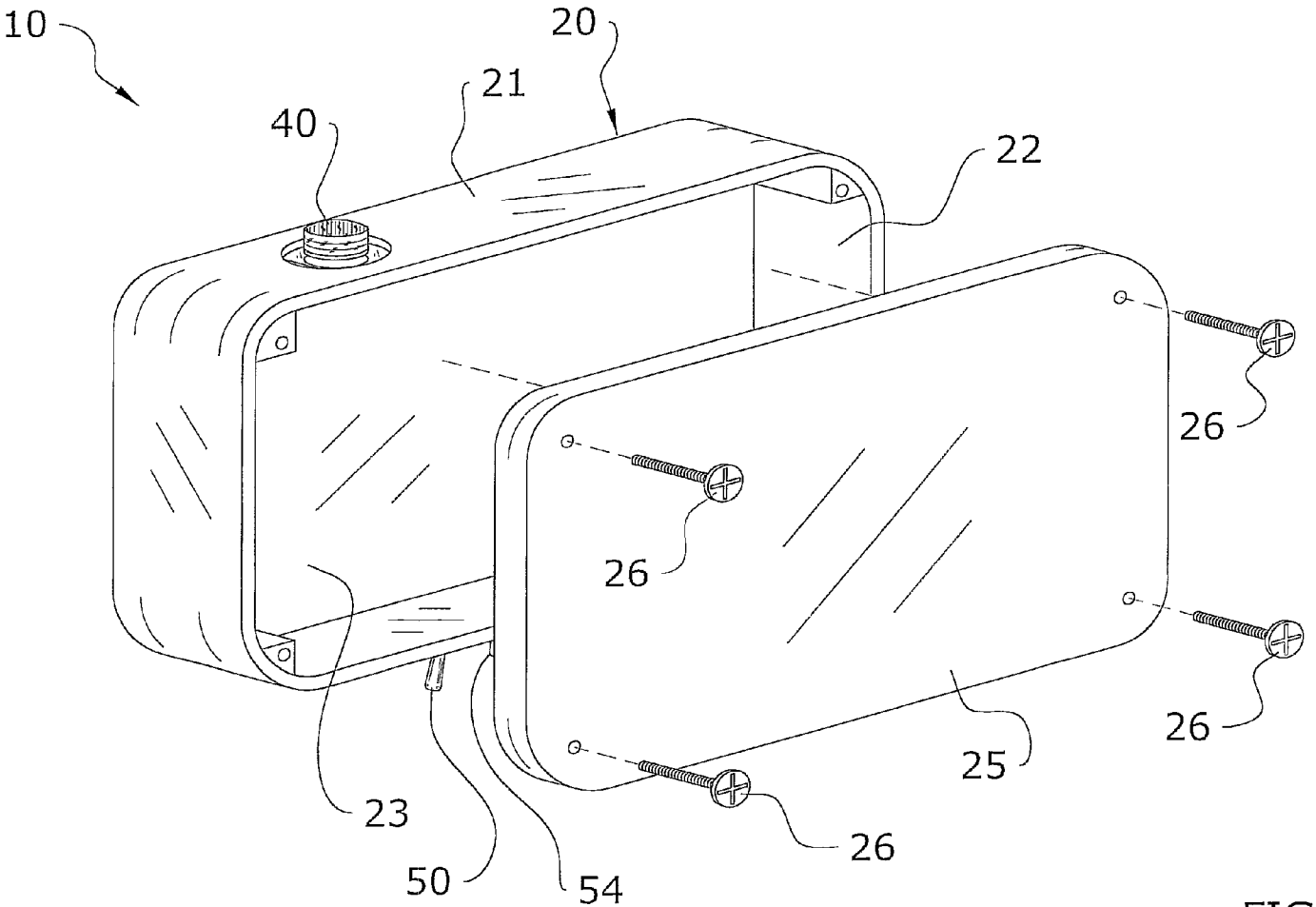
FIG. 3 is an upper front perspective view of the present invention with the cover exploded from the housing.
Figure 4:
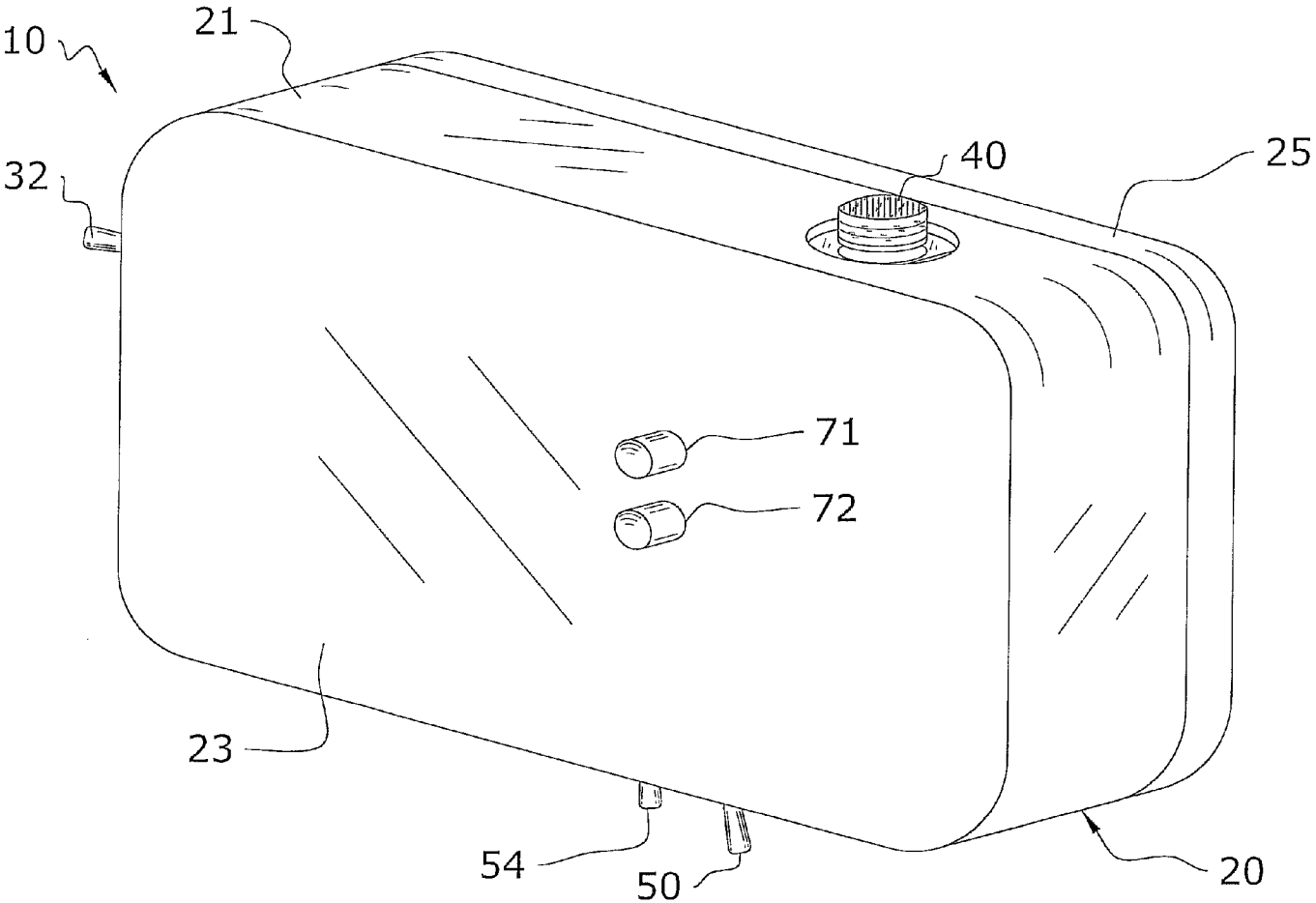
FIG. 4 is an upper rear perspective view of the present invention.
Figure 5:
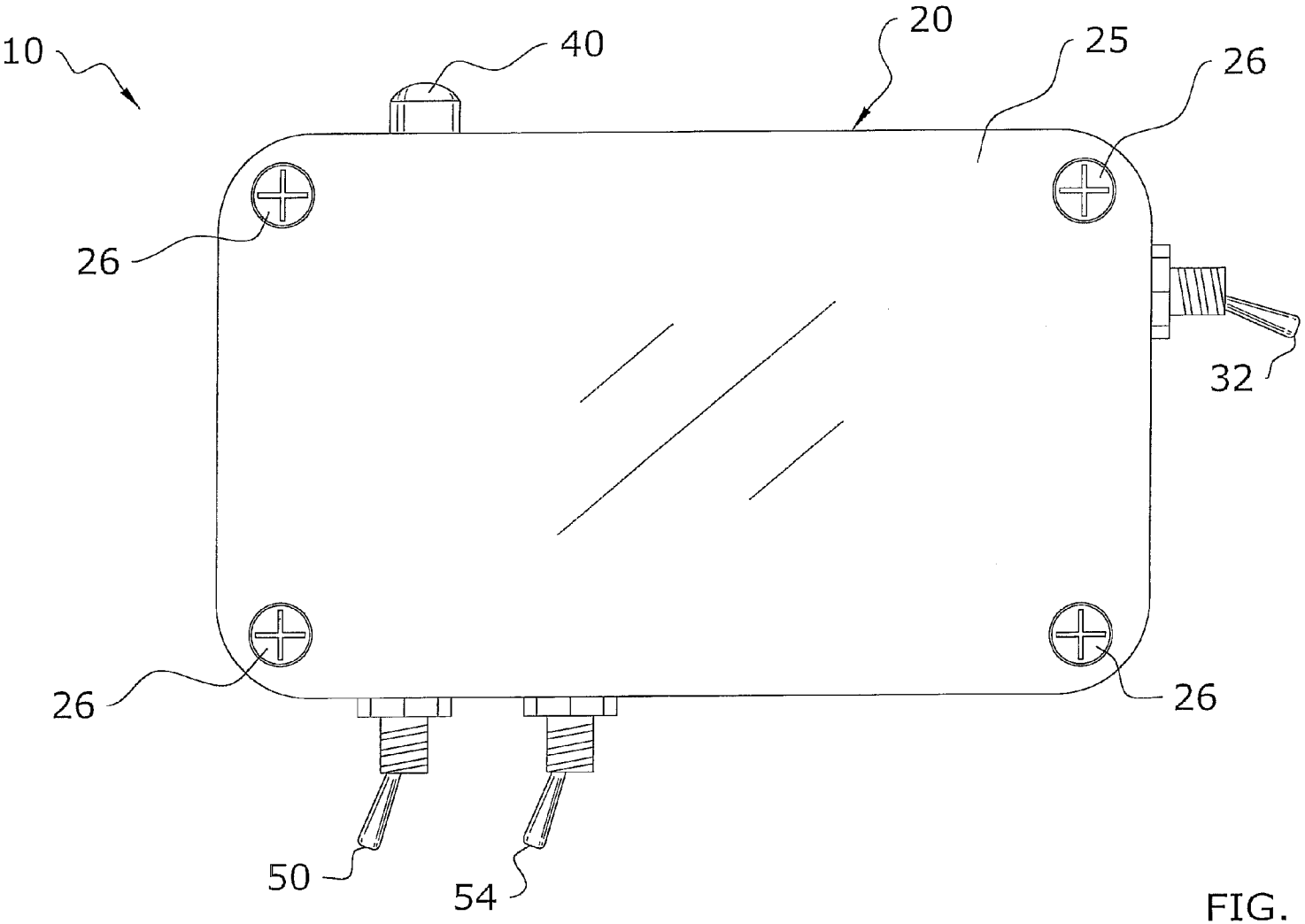
FIG. 5 is a front view of the present invention.
Figure 6:
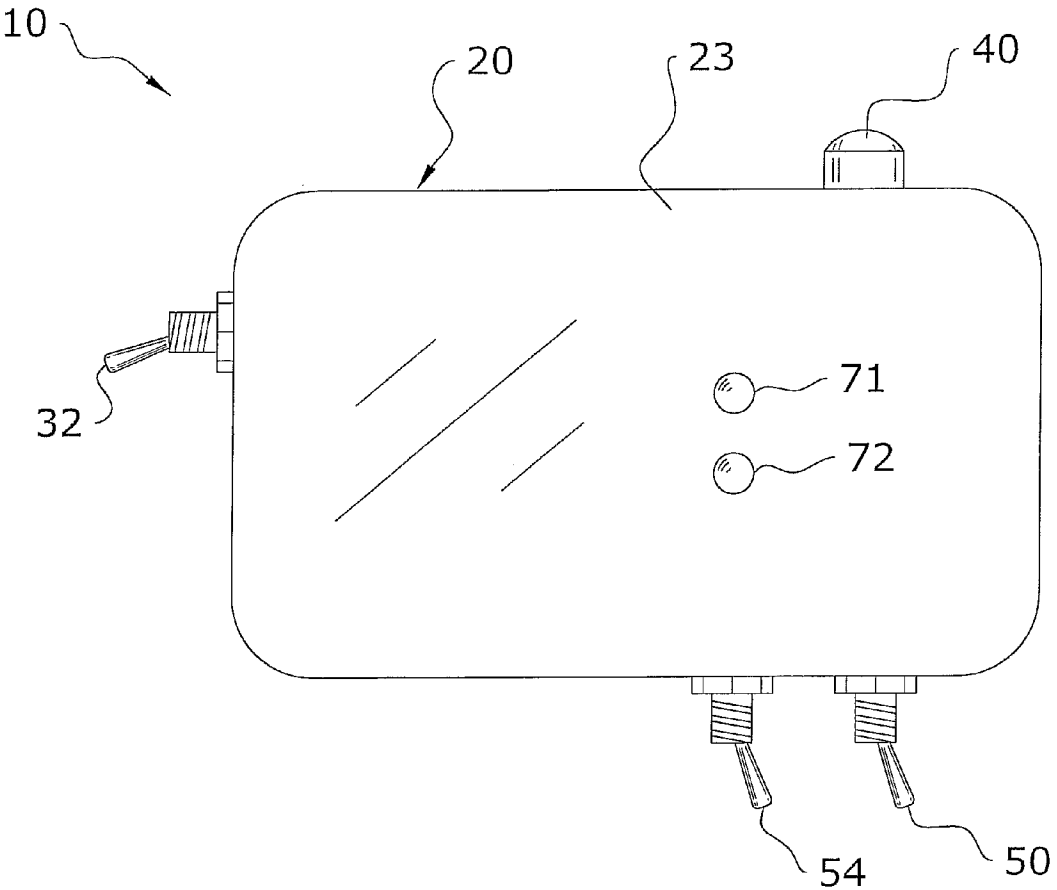
FIG. 6 is a rear view of the present invention.

Turning now descriptively to the drawings, in which similar reference characters denote similar elements throughout the several views, FIGS. 1 through 10 illustrate a wireless guitar synthesizer 10, which comprises a portable housing 20 adapted to be moved independent of an electric guitar 12 to influence a sound 17 outputted by an audio means 15 connected to the guitar and a circuit 30 supported by the housing 20 for generating an electromagnetic field 19 to be received by the coil pickup 13 of the guitar 12 to influence the outputted sound 17. The circuit 30 generally includes a signal generator 34 for producing an output signal, at least one user-adjustable modulator 40 electrically coupled to the signal generator 34 for varying the output signal, and an LED antenna array 71-74 electrically coupled to the signal generator 34 to receive the modulated output signal and output the electromagnetic field 19. The user-adjustable modulators may include a joystick 40 movable along an X-Y axis, as well as a plurality of switches 50, 54, each of which independently alter the output signal.

The device 10 is separate from the guitar 12 and does not require modification of the guitar 12 in any manner. The device 10 can be played with either hand of the user and may be operated in a predictable manner to produce theremin-like sounds through the amplifier 15 of the guitar 12. The guitar 12 has limited electromagnetic field range to reduce changes of undesired interference with other electronic or magnetic devices.

B. Housing

The housing 20 generally holds the circuit 30 therein and is positioned in close proximity to the electric guitar 12 so that the electromagnetic waves 19 emitted from the circuit 30 can be received by the coil pickup 13 of the electric guitar 12 and reproduced into sound waves 17 through a loudspeaker, such as an amplifier 15. The housing 20 may also be mounted to the electric guitar 12 or may be secured to the user via a strap, etc.

The housing 20 is generally box-shaped and includes sidewalls 21 and a back wall 23. The sidewalls 21 define an opening 22 for accessing the circuit 30 and power supply 31. The housing 20 includes a removable cover 25 that is secured over the opening 22 via fasteners 26, such as screws, etc. The housing 20 may be comprised of various materials, such as but not limited to aluminum or plastic. The housing 20 is further preferably comprised of a size to be handheld and portable.

C. Circuit

The circuit 30 is used to generate pulsating or resonating electromagnetic waves 19 that are emitted therefrom to be received by the electromagnetic coil pickup 13 of the electric guitar 12. The circuit 30 is contained within the housing 20 except for the portions of the joystick 40 and switches 32, 50, 54, 70 that extend from the housing 20 for user-adjustability. The circuit 30 generally includes a signal generator 34, one or more user-adjustable modulators 40, switches 32, 50, 54, 70, a power supply 31, switching transistors 60, 64, and LED antennas 71-74 for outputting the electromagnetic waves 19.

The circuit 30 preferably includes its own on-board power supply 31, such as batteries or rechargeable batteries. The housing 20 may also include its own port leading to the power supply 31 for recharging the batteries. The power supply 31 is preferably activated via an external rocker-type switch.

Figure 7:
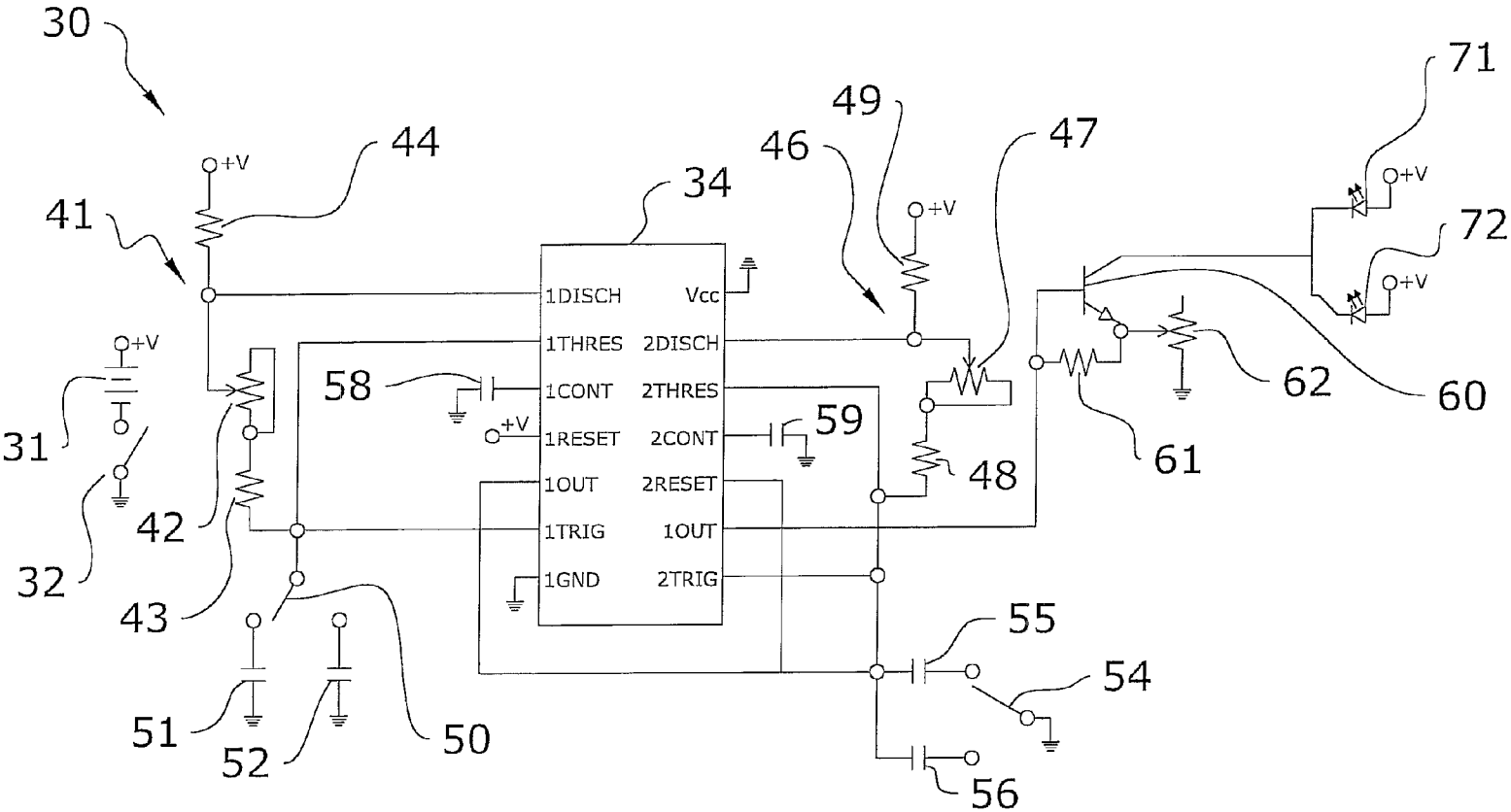
FIG. 7 is a schematic view of the preferred circuit.
Figure 8:
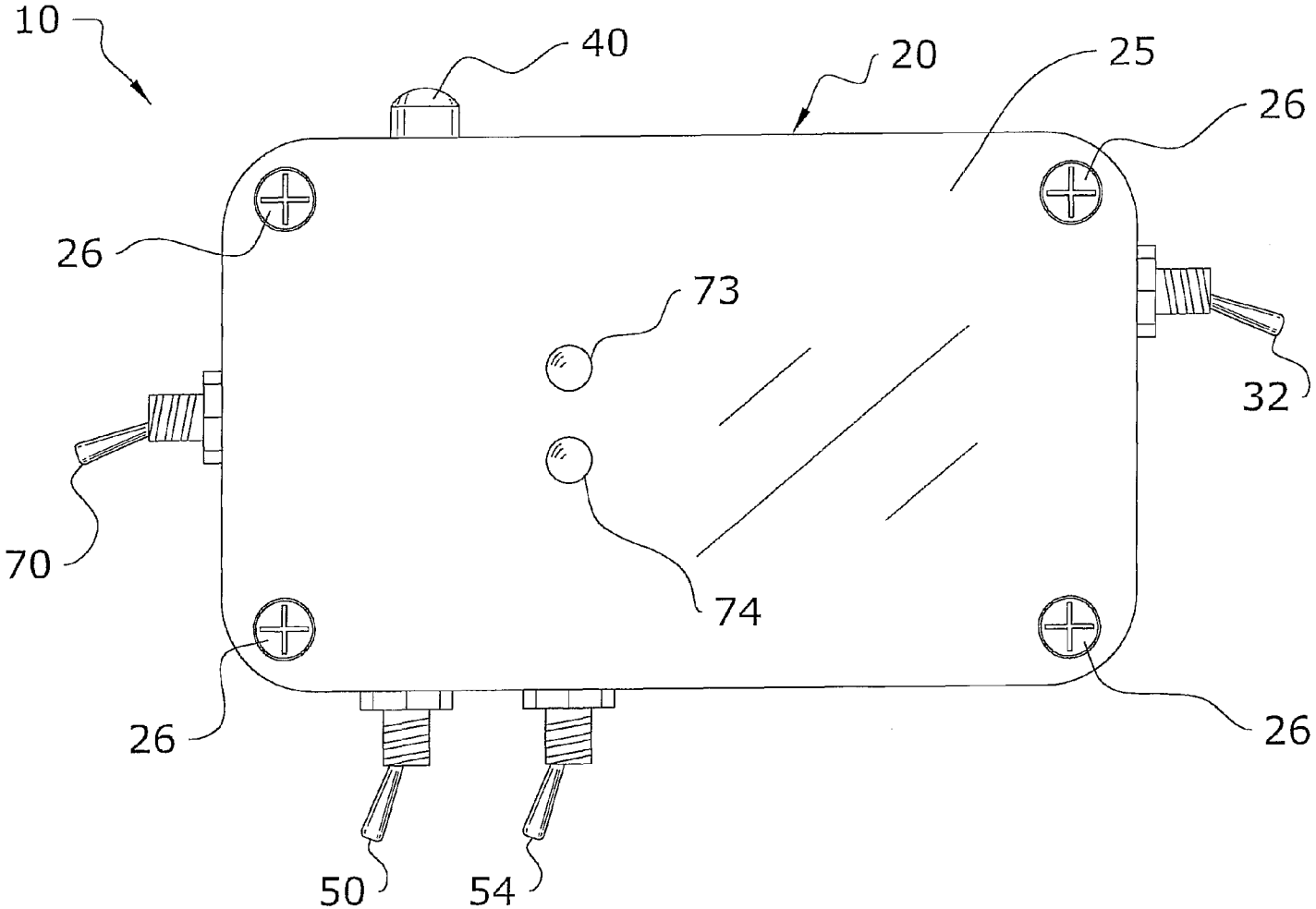
FIG. 8 is a front view of an alternate embodiment of the present invention having two sets of LED antennas, wherein one set is positioned along the cover and one set is positioned along the back wall and wherein the present invention includes a switch for choosing a desired set.
Figure 9:
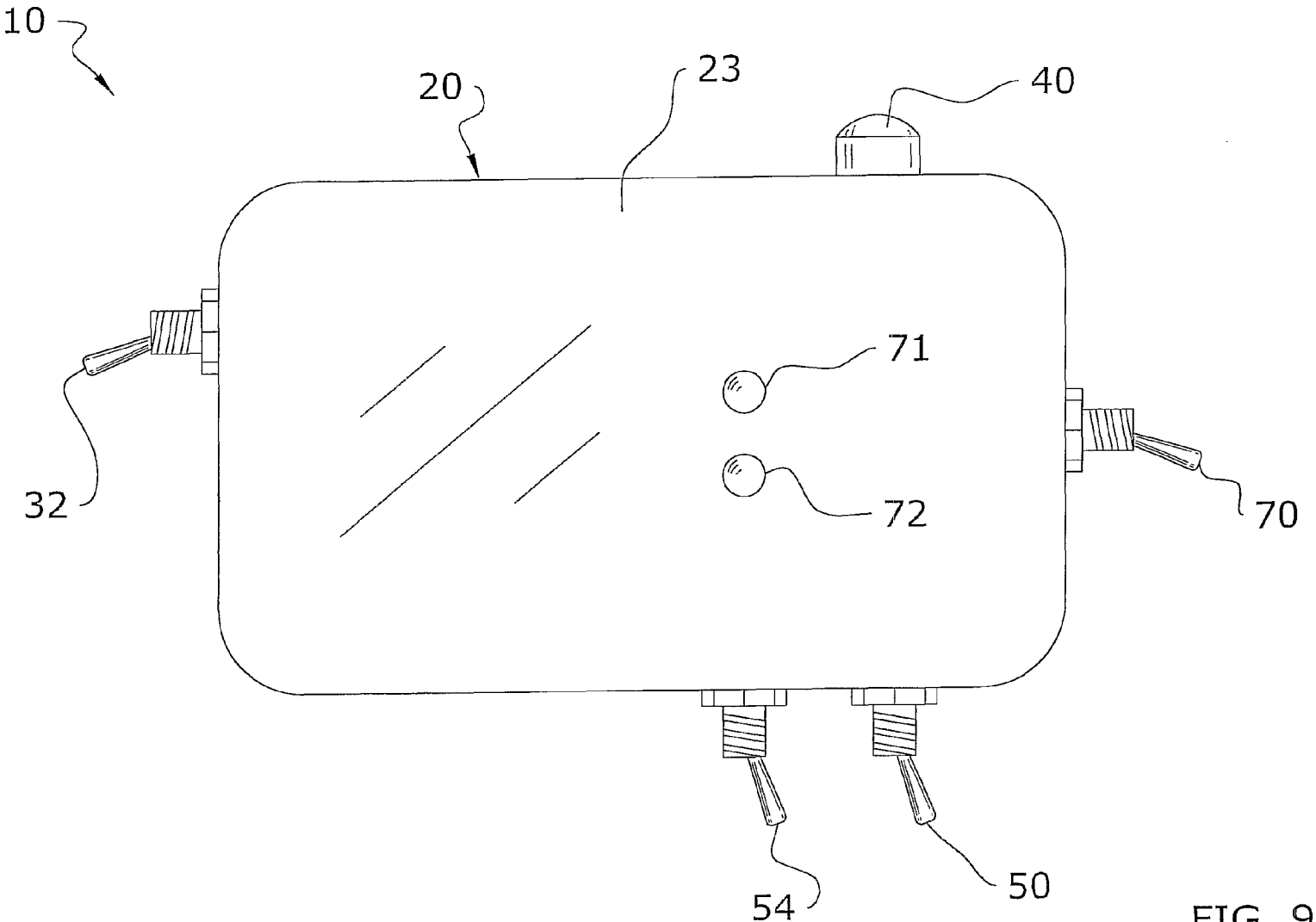
FIG. 9 is a rear view of the alternate embodiment of the present invention as shown in FIG. 8.
Figure 10:
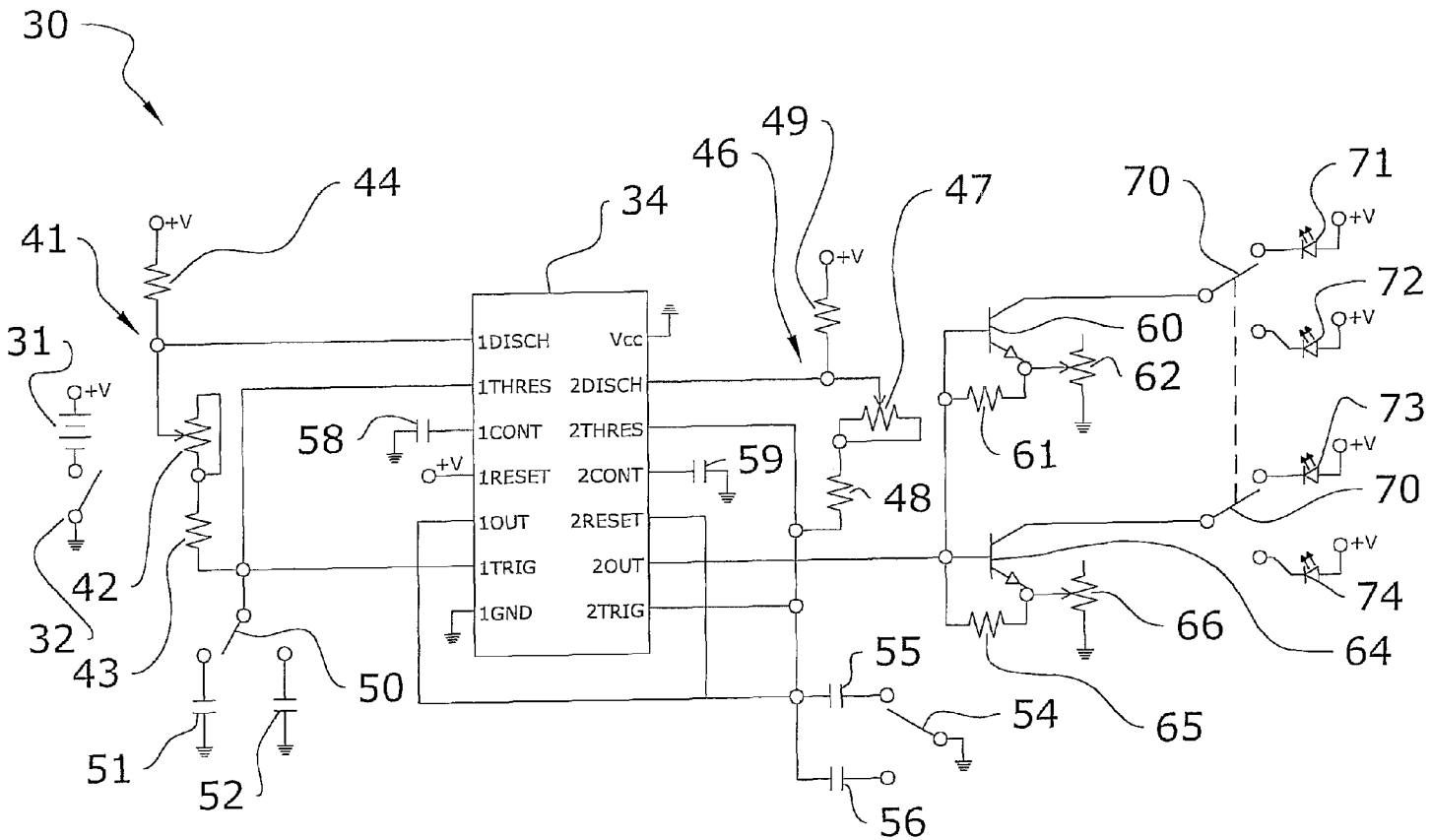
FIG. 10 is a schematic view of the alternate circuit as associated with the embodiment illustrated in FIGS. 8 and 9.

The signal generator 34 is preferably a LM556 dual timer chip configured for cascaded operation with switchable ranges for coarse frequency adjustment. The signal generator 34 is configured in a stable mode so that a first timer of the dual timer of the signal generator 34 switches a second timer of the dual timer of the signal generator 34 off and on at low frequencies while the second timer creates an audio tone that is switched between high and low ranges. The timers of the signal generator 34 are controlled via various user-adjustable modulators 40 and switches 50, 54. Pin designations of the signal generator 34 are indicated in FIGS. 7 and 10. In place of the signal generator 34, the circuit 30 can also use cascaded opamps to generate multiple waveform shapes for different sounds, the frequencies can be used for heterodyning and multiple ranges added for subsonic and ultrasonic frequencies along with their audible harmonics.

The switching transistors 60, 64 are generally comprised of a 2N2222 type and preferably have a trimming potentiometer 62, 66 or other adjustment mechanism to provide antenna current control and balancing and resistors 61, 65 to control current flow. In place of the transistors 60, 64, the circuit 30 can also use mosfets, opamps or comparators to drive the antennas and a feedback loop for maximizing and stabilizing current flow through the antennas 71-74.

The present invention generally includes one or two pairs of antennas 71, 72 and 73, 74 and related wiring mounted to just the back wall 23 of the housing 20 or the back wall 23 of the housing 20 and the cover 25 such that each set of antennas 71-74 in a pair are parallel to each other so either both antennas 71, 72 simultaneously are activated upon the back wall 23 or the both antennas 73, 74 are simultaneously activated upon the cover 25. The antennas 71, 72 or 73, 74 along the same face of the housing 20 or cover 25 are also preferably close together (e.g. ⅛" apart) so their electromagnetic fields 19 overlap each other for enhanced energy transfer. In the preferred embodiment, the antennas 71, 72 are preferably only located along the back wall 23 and not upon the cover 25 so as to allow easy removal of the cover 25 to access the power supply 31 within the housing 20 without having to possibly disrupt wiring connections as illustrated in FIGS. 1 through 7.

However, having antennas 71-74 upon both the back wall 23 and the cover 25 allows for a user to more comfortably orient the antennas 71-74 toward the coil pickup 13 of the guitar with either their right hand or their left hand. For example, a right-handed guitar player may desire to activate a first pair of the antennas 71, 72 so as to comfortably hold the device 10 in position to provide easy access to the joystick 40. Contrarily, a left-handed guitar player may desire to activate a second pair of the antennas 73, 74 so as to comfortably hold the device 10 in an oppositely oriented position to provide easy access to the joystick 40. In the preferred embodiment of only one set of antennas 71, 72 on the back wall 23 of the housing 20 and none on the cover 25, the user would either buy a left-handed or right-handed version of the device 10.

The antennas 71-74 and their related wiring can be mounted in different orientations to cause different interference patterns and can be different power ratings, colors, or sizes. The antennas 71-74 are preferably comprised of a high power LEDs; however other types of antennas may be utilized, such as but not limited to non lighting diodes. The LEDs may also flash and/or change colors to produce stage effects.

A user-adjustable modulator 40, such as but not limited to a miniature joystick, may also be connected to the signal generator 34 so that changing the position of the modulator 40 alters the output frequencies emitted by the timers of the signal generator 34 and changes the output waveform of the antennas 71-74 in a predictable manner. The modulator 40 generally includes a shaft and a knob, wherein the shaft is movable in any direction in an X-Y plane.

The modulator 40 includes and controls a first adjustment assembly 41 electrically coupled thereto for modulating the output signal of the signal generator 34 in response to a movement of the modulator 40 along an X-axis of the X-Y plane. The modulator 40 also generally includes and controls a second adjustment assembly 46 electrically coupled thereto for modulating the output signal of the signal generator 34 in response to a movement of the modulator 40 along a Y-axis of the X-Y plane.

The first adjustment assembly 41 is independently operable relative the second adjustment assembly 46. The first adjustment assembly 41 generally includes a potentiometer 42 and resistors 43, 44. The second adjustment assembly 46 also generally includes a potentiometer 47 and resistors 48, 49.

In place of the modulator 40, the circuit 30 can use miniature rotary potentiometers that are not in an X-Y axis configuration or slide potentiometers. Other types of devices suitable for the modulator 40 for changing output frequencies of the signal generator 34 include devices using the Hall Effect, and thermal, visible or infrared light sensors. The various components of the circuit 30 may be connected on a printed circuit board (PCB) via various methods, such as discrete wiring, traces, etc.

The circuit 30 also generally includes a first user-adjustable range switch 50 electrically coupled to the first adjustment assembly 41 and a second user-adjustable range switch 54 electrically coupled to the second adjustment assembly 46 for further modulating the output signal. The range switches 50, 54 are preferably comprised of rocker-type switches extending from the sidewall 21 of the housing 20. The first user-adjustable range switch 50 is independently operable relative the second user-adjustable range switch 54. It is preferred that a multitude of different output waveforms of the signal generator 34 and thus resultant sounds can be achieved by different combinations of positions of either range switch 50, 54 along with different combinations of the joystick modulator 40. Each range switch 50, 54 selectively electrically connects a different capacitor 51, 52 or 55, 56 having a different value. Other capacitors 58, 59 are also used with the signal generator 34 as appreciated and shown in FIGS. 7 and 10.

The modulated output signal or waveform of the signal generator 34 is sent to the one or more transistors 60, 64. Each transistor 60, 64 preferably includes an adjustable potentiometer 62, 66 and resistor 61, 65 as shown. In the case of multiple transistors 60, 64 and thus multiple pairs of LED antennas 71, 72 and 73, 74, an external rocker-type switch 70 is used to select between the different pairs of LED antennas 71, 72 and 73, 74. Suitable values for each of the components have been set forth in the table below:

| Element and Reference Numeral | Value |
|---|---|
| Power Supply 31 | 9 Volts |
| Potentiometer 42 | 100 KΩ |
| Resistor 43 | 10 KΩ |
| Resistor 44 | 180 Ω |
| Potentiometer 47 | 100 KΩ |
| Resistor 48 | 1 KΩ |
| Resistor 49 | 180 Ω |
| Capacitor 51 | 1 μF |
| Capacitor 52 | 10 μF |
| Capacitor 55 | .47 μF |
| Capacitor 56 | .047 μF |
| Capacitor 58 | .01 μF |
| Capacitor 59 | .01 μF |
| Resistor 61 | 10 KΩ |
| Potentiometer 62 | 500 Ω |
| Resistor 65 | 10 KΩ |
| Potentiometer 66 | 500 Ω |
| Antenna 71 | 1000 mcd |
| Antenna 72 | 1000 mcd |
| Antenna 73 | 1000 mcd |
| Antenna 74 | 1000 mcd |

The circuit 30 is preferably configured so that more audible frequency ranges and possibly subsonic and/or ultrasonic operation can be added by changing the timing capacitors and their respective switches. The circuit 30 can produce multiple waveform outputs by using cascaded op-amps or timer circuits and resonant analog circuitry. Alternate circuits could use light, magnetic, motion, or proximity sensors to alter the output frequencies instead of modulators using potentiometers. Further alternate circuits may use PLL or direct feedback loops to maximize and stabilize LED current. Alternative configurations of the LED antennas 71-74 to modify the shape and size of the electromagnetic field 19 may be employed as well as use of ordinary diodes or other active components.

D. Operation of Preferred Embodiment

In use, the operator holds the housing 20 in close proximity to the pickup 13 of the electric guitar 12 and activates the circuit 30 by operating the power switch 32. Once powered, the signal generator 34 begins to create waveforms that are amplified through the transistor 60 and that drive the LED antennas 71, 72 to emit an electromagnetic field 19 that is sensed and captured by the electromagnetic coil pickup 13 of the electric guitar 12 causing an audio output 17 from the audio means, such as the exemplary amplifier 15 connected to the guitar 12 via the cord 16.

The modulator 40 position changes the frequencies emitted by the timers of the signal generator 34 which cause the output waveform to vary, changing the electromagnetic field 19 and thus the sound waves 17 produced by the audio means 15. The current driven in each LED antenna 71, 72 is balanced and maximized using the trimming potentiometers 62, 66 and observing the LED antennas 71, 72 for brightness and adjusting them for approximately 15% below maximum current flow.

The housing 20 is held in the hand so the joystick 40 and range switches 50, 54 are accessible to the thumb and index forefinger and the LED antennas 71, 72 are positioned so the illuminated LED antennas 71, 72 point away from the operating hand and toward the pickup 13. The operator may switch the guitar 12 to the low range pickup 13 to better sense the electromagnetic field 19 from the LED antennas 71, 72. The housing 20 may be moved around until a "sweet spot" is found where the electromagnetic fields 19 from the LED antennas 71, 72 are focused on the pickup 13 and maximum volume through the amplifier 15 is achieved, thus allowing the user to control the output volume by changing the position of the housing 20 and thus LED antennas 71, 72 in relation to the pickup 13 of the guitar 12.

The tone and pulsing are changed using the joystick modulator 40 for fine tuning and the range switches 50, 54 are altered in position for coarse tuning. Additional effects can be produced by changing the orientation and location of the device 10 in relation to the guitar 12 and experimenting with the other controls on the guitar 12 and amplifier 13. The device 10 preferably causes a theremin-like sound to be outputted from the amplifier 13.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A portable device to be independently directed toward a musical instrument to influence a sound produced by the musical instrument, comprising:

a signal generator for producing an output signal;

a user-adjustable modulator electrically coupled to said signal generator for varying said output signal emitted from said signal generator; and antenna means electrically coupled to said signal generator to receive said modulated output signal;

wherein said antenna means is adapted to emit an electromagnetic field from said modulated output signal to be wirelessly captured by an electric guitar that has an electromagnetic coil pickup that converts said electromagnetic field from said antenna means to an electrical signal which is emitted in the form of sound through an audio output means connected thereto;

wherein said antenna means is comprised of at least one LED.

2. The portable device for a musical instrument of claim 1, wherein said signal generator is comprised of a dual timing circuit for permitting frequency adjustment.

3. The portable device for a musical instrument of claim 1, wherein said user-adjustable modulator is comprised of joystick movable in any direction in an X-Y plane.

4. The portable device for a musical instrument of claim 3, wherein said joystick includes means for generating modulations of said output signal along either an X-axis or a Y-axis of said X-Y plane.

5. The portable device for a musical instrument of claim 4, wherein said joystick includes a first adjustment assembly electrically coupled thereto for modulating said output signal in response to a movement of said joystick along said X-axis.

6. The portable device for a musical instrument of claim 5, wherein said joystick includes a second adjustment assembly electrically coupled thereto for modulating said output signal in response to a movement of said joystick along said Y-axis.

7. The portable device for a musical instrument of claim 6, wherein said first adjustment assembly is independently operable relative said second adjustment assembly.

8. The portable device for a musical instrument of claim 7, including a first user-adjustable range switch electrically coupled to said first adjustment assembly and a second user-adjustable range switch electrically coupled to said second adjustment assembly for further modulating said output signal.

9. The portable device for a musical instrument of claim 8, wherein said first user-adjustable range switch is independently operable relative said second user-adjustable range switch.

10. The portable device for a musical instrument of claim 1, wherein said at least one light emitting diode is comprised of a plurality of LEDs.

11. The portable device for a musical instrument of claim 10, wherein a first portion of said plurality of LEDs are directed in a first direction or a second portion of said plurality of LEDs are directed in a second direction, wherein said first direction is opposite said second direction.

12. The portable device for a musical instrument of claim 11, including a user-adjustable switch electrically coupled to said signal generator for activating either said first portion of said plurality of LEDs or said second portion of said plurality of LEDs.

13. A portable device to be independently directed toward an electric guitar to influence a sound produced by the electric guitar, comprising:

a housing comprised of a self-contained and portable structure; and a circuit means supported by said housing, wherein said circuit means includes:

a power supply contained within said housing, wherein said power supply has operable on/off switching means;

a signal generator powered by said power supply, wherein said signal generator is for producing an output signal;

a user-adjustable modulator electrically coupled to said signal generator for varying said output signal emitted from said signal generator; and antenna means electrically coupled to said signal generator to receive said modulated output signal;

wherein said antenna means is adapted to output an electromagnetic field from said modulated output signal;

wherein said electromagnetic field is adapted to be wirelessly captured by an electric guitar that has an electromagnetic coil pickup that converts said electromagnetic field from said antenna means to an electrical signal to be outputted in the form of sound;

wherein movement of said antenna means relative said electromagnetic coil pickup causes alteration of a strength of said electromagnetic field received by said electromagnetic coil pickup and thus alters an outputted sound.

14. The portable device for an electric guitar of claim 13, wherein said signal generator is comprised of a dual timing circuit for permitting frequency adjustment.

15. The portable device for an electric guitar of claim 13, wherein said user-adjustable modulator is comprised of joystick movable in any direction in an X-Y plane.

16. The portable device for an electric guitar of claim 15, wherein said joystick includes:

a first adjustment assembly electrically coupled thereto for modulating said output signal in response to a movement of said joystick along a X-axis of said X-Y plane; and a second adjustment assembly electrically coupled thereto for modulating said output signal in response to a movement of said joystick along a Y-axis of said X-Y plane;

wherein said first adjustment assembly is independently operable relative said second adjustment assembly.

17. The portable device for an electric guitar of claim 16, wherein said circuit means includes:

a first user-adjustable range switch electrically coupled to said first adjustment assembly; and a second user-adjustable range switch electrically coupled to said second adjustment assembly for further modulating said output signal;

wherein said first user-adjustable range switch is independently operable relative said second user-adjustable range switch.

18. The portable device for an electric guitar of claim 13, wherein said antenna means is comprised of at least one LED.

19. A system for influencing a sound produced by the electric guitar, comprising:

an electric guitar having an electromagnetic coil pickup;

an audio output means electrically coupled to said electric guitar for outputting sound from an electric signal received from said electromagnetic coil pickup of said electric guitar; and a portable and self contained device for outputting an electromagnetic field to influence said electromagnetic coil pickup of said electric guitar causing an influenced sound to be outputted through said audio output means;

wherein said device includes a housing having a removable cover attached thereto;

wherein said device includes a circuit means supported by said housing, wherein said circuit means includes:

a power supply contained within said housing, wherein said power supply has operable on/off switching means;

a signal generator powered by said power supply, wherein said signal generator is for producing an output signal;

wherein said signal generator is comprised of a dual timing circuit;

a user-adjustable modulator electrically coupled to said signal generator for varying said output signal emitted from said signal generator;

wherein said user-adjustable modulator is comprised of joystick movable in any direction in an X-Y plane;

wherein said user-adjustable modulator is includes a first adjustment assembly electrically coupled thereto for modulating said output signal in response to a movement of said joystick along an X-axis;

wherein said user-adjustable modulator is includes a second adjustment assembly electrically coupled thereto for modulating said output signal in response to a movement of said joystick along a Y-axis;

wherein said first adjustment assembly is independently operable relative said second adjustment assembly;

a first user-adjustable range switch electrically coupled to said first adjustment assembly and said signal generator for modulating said output signal;

a second user-adjustable range switch electrically coupled to said second adjustment assembly and said signal generator for modulating said output signal;

wherein said first user-adjustable range switch is independently operable relative said second user-adjustable range switch; and a pair of LED antennas electrically coupled to said signal generator to receive said modulated output signal;

wherein said pair of LED antennas is adapted to output an electromagnetic field from said modulated output signal;

wherein said electromagnetic field is adapted to be wirelessly captured by said electromagnetic coil pickup to be converted to an electrical signal to be outputted in the form of sound through said audio output means;

wherein movement of said device relative said electromagnetic coil pickup causes alteration of a strength of said electromagnetic field received by said electromagnetic coil pickup and thus alters said outputted sound.

* * * * *